US006672392B2

(12) United States Patent
Reitz

(10) Patent No.: US 6,672,392 B2
(45) Date of Patent: Jan. 6, 2004

(54) GAS RECOVERY APPARATUS, METHOD AND CYCLE HAVING A THREE CHAMBER EVACUATION PHASE FOR IMPROVED NATURAL GAS PRODUCTION AND DOWN-HOLE LIQUID MANAGEMENT

(76) Inventor: Donald D. Reitz, 7484 E. Cedar Ave., Denver, CO (US) 80230

( * ) Notice: Subject to any disclaimer, the term of this patent is extended or adjusted under 35 U.S.C. 154(b) by 17 days.

(21) Appl. No.: 10/096,881

(22) Filed: Mar. 12, 2002

(65) Prior Publication Data

US 2003/0183394 A1 Oct. 2, 2003

(51) Int. Cl.[7] ..... E21B 43/12
(52) U.S. Cl. ..... 166/372; 166/53; 166/68
(58) Field of Search ..... 166/372, 68, 53; 417/142, 138, 137, 144, 145, 149

(56) References Cited

U.S. PATENT DOCUMENTS 1,853,269 A 4/1932 Harris
2,016,433 A 10/1935 Humason (List continued on next page.)

FOREIGN PATENT DOCUMENTS

SU 570697 8/1977

OTHER PUBLICATIONS

Kermit Brown, *The Technology of Artificial Life Methods*, vol. 2, pp. 125–131, 1977.

E.E. DeMoss, *4 New Ways to Reduce Artificial Lift Expense*, World Oil, pp. 63 and 64, May 1973.

H.W. Winkler et al., *Down–Hole Chambers Increase Gas–Lift Efficiency*, The Petroleum Engineer, part 1—Jun. 1956; part 2—Aug. 1956.

H.W. Winkler et al., *Chamber Design*, CAMCO Gas Lift Manual, Chapter VII, pp. 7–001–7–015, 1962.

John T. Dewan, et al., *Lifting of Heavy Oil with Inert–Gas–Operated Chamber Pumps*, SPE 9913, pp. 277–285 plus illustrations.

Steve B. Coleman et al., *A New Look at Predicting Gas–Well Load–Up*, JPT, Mar., 1991.

Steve B. Coleman et al., *Understanding Gas–Well, Load–Up Behavior*, JPT, Mar., 1991.

E.E. DeMoss et al., *Liquid Removal from Gas Wells—Gas Lifting with Reservoir Gas*, Apr. 1968.

*Primary Examiner*—Hoang Dang
(74) *Attorney, Agent, or Firm*—John R. Ley

(57) ABSTRACT

Natural gas produced from a well by executing a multiple-phase gas recovery cycle which includes a phase during which a relatively lower evacuation pressure is applied within the entire well bore to assist in accumulating liquids at a well bottom. The relatively lower evacuation pressure augments the national earth formation pressure to produce natural gas and liquid more rapidly. The phases of the gas recovery cycle are also coordinated with the phase in which the relatively lower evacuation pressure is applied throughout the well to facilitate a greater natural gas production rate.

34 Claims, 6 Drawing Sheets

U.S. PATENT DOCUMENTS 2,142,773 A 1/1939 Athey
2,698,581 A 1/1955 Maier
3,090,316 A 5/1963 Montgomery
3,884,299 A 5/1975 McCarter et al.
3,894,583 A 7/1975 Morgan
3,941,510 A 3/1976 Morgan
3,991,825 A 11/1976 Morgan
4,509,599 A 4/1985 Chenoweth et al.
4,527,633 A 7/1985 McLaughlin et al.
4,653,989 A 3/1987 Mason
4,708,595 A 11/1987 Maloney et al.
4,711,306 A 12/1987 Bobo
4,741,673 A 5/1988 Jubb
4,768,595 A 9/1988 Smith
4,844,156 A 7/1989 Hesh
4,923,372 A 5/1990 Ferguson et al.
5,006,046 A 4/1991 Buckman et al.
5,069,285 A 12/1991 Nuckols
5,211,242 A 5/1993 Coleman et al.
5,374,163 A 12/1994 Jaikaran
5,407,010 A * 4/1995 Herschberger ..... 166/372
5,417,281 A 5/1995 Wood et al.
5,431,222 A 7/1995 Bustamante
5,488,993 A 2/1996 Hershberger
5,522,463 A 6/1996 Barbee
5,544,706 A 8/1996 Reed
5,611,397 A 3/1997 Wood
5,611,671 A 3/1997 Tripp, Jr.
5,655,605 A 8/1997 Matthews
5,671,813 A 9/1997 Lima
5,911,278 A 6/1999 Reitz
2002/0007953 A1 * 1/2002 Liknes ..... 166/372

* cited by examiner

GAS RECOVERY APPARATUS, METHOD AND CYCLE HAVING A THREE CHAMBER EVACUATION PHASE FOR IMPROVED NATURAL GAS PRODUCTION AND DOWN-HOLE LIQUID MANAGEMENT

This invention relates primarily to producing natural gas from a well formed in an earth formation, and more particularly to a new and improved gas recovery system, method and gas recovery cycle during which an evacuation pressure is applied to three chambers within the well and a hydrocarbon-bearing zone of the earth formation to assist natural formation pressure in producing natural gas and liquid into the well. The resulting three chamber evacuation phase augments the effect of natural earth formation pressure to produce gas and liquid at a higher volumetric rate, thereby increasing the efficiency of gas production, lifting the liquid from the well by more efficient and shorter recovery cycles, and improving efficiency by better use and conservation of the existing pressure states within the chambers during the recovery cycle, among other things.

BACKGROUND OF THE INVENTION

The production of oil and natural gas depends on natural pressure within the earth formation at the bottom of a well bore, as well as the mechanical efficiency of the equipment and its configuration within the well bore to move the hydrocarbons from the earth formation to the surface. The natural formation pressure forces the oil and gas into the well bore. In the early stages of a producing well when there is considerable formation pressure, the formation pressure may force the oil and gas entirely to the earth surface without assistance. In later stages of a well's life after the formation pressure has diminished, the formation pressure is effective only to move liquid and gas from the earth formation into the well. The formation pressure pushes liquid and gas into the well until a hydrostatic head created by a column of accumulated liquid counterbalances the natural earth formation pressure. Then, a pressure equilibrium condition exists and no more oil or gas or water flows from the earth formation into the well. The hydrostatic head pressure from the accumulated liquid column chokes off the further flow of liquid into the well bore, causing the well to "die," unless the accumulated liquid is pumped or lifted out of the well.

By continually removing the liquid, the hydrostatic head pressure from the accumulated column of liquid remains less than the natural earth formation pressure. Under such circumstances, the natural earth formation pressure continues to move the liquid and gas into the well, allowing the liquid and gas to be recovered or produced. At some point when the natural earth formation pressure has diminished significantly, the cost of removing the liquid diminishes the value of the recovered oil and gas to the point where it becomes uneconomic to continue to work the well. Under those circumstances, the well is abandoned because it is no longer economically productive. A deeper well will require more energy to pump the liquid from the well bottom, because more energy is required to lift the liquid the greater distance to the earth surface. Deeper wells are therefore abandoned with higher remaining formation pressure than shallower wells.

To keep wells in production, it is necessary to remove the accumulated liquid to prevent the liquid from choking off the flow of gas into a gas producing well, but because a considerably greater volume of gas is usually produced into a well compared to the amount of liquid produced into the well, the greater volume of gas can be recovered more economically by removing a relatively lesser volume of the accumulated liquid. Consequently, there may be an economic advantage to recovering natural gas at the end of a well's lifetime, because the gas is more economically recovered as a result of removing a relatively smaller amount of accumulated liquid. These factors are particularly applicable to recovering gas from relatively deep wells.

Gas pressure lift systems have been developed to lift liquid from wells under circumstances where mechanical pumps would not be effective or not sufficiently economical. In general, gas pressure lift systems inject pressurized gas into the well to force the liquid up from the well bottom, rather than rely on mechanical pumping devices to lift the liquid. The injected gas may froth the liquid by mixing the heavier density liquid with the lighter density gas to reduce the overall density of the lifted material. Alternatively, "slugs" or shortened column lengths of liquid are separated by bubble-like spaces of pressurized gas, again reducing the overall density of the lifted material. In both cases, the amount of energy required to lift the material is reduced, or for a given amount of energy it is possible to lift material from a greater depth.

One problem with injecting pressurized gas into a well casing is that the pressurized gas tends to oppose the natural formation pressure. The injected gas pressure counterbalances the formation pressure to inhibit or diminish the flow of liquids and natural gas into the well. Once the gas pressure is removed, the natural earth formation will again become effective to move the liquid and gas into the well. However, because the casing annulus is pressurized for a significant amount of time during each production cycle, the net effect is that the injected gas pressure diminishes the production of the well. Stated alternatively, producing a given amount of liquid and gas from the well requires a longer time period to accomplish. Such reductions in the production efficiency in the later stages of the well's life may be so significant that it becomes uneconomical to work the well, even though some amount of hydrocarbons remain in the formation.

One particularly advantageous type of pressurized gas lift apparatus is described in U.S. Pat. 5,911,278, by the inventor hereof. The gas lift apparatus described in U.S. Pat. 5,911,278 is primarily intended for lifting oil from a well, rather than natural gas, but it is also effective for producing natural gas. The gas lift apparatus described in this patent uses a production tube inserted into the well casing with a lift to be located within the production tube. A one-way valve located at the bottom of the production tube responds to pressure differentials to selectively isolate the earth formation from the pressure of gas injected in the production tube. By confining the injected pressurized gas within the production tubing, and by not applying the injected pressurized gas directly to the earth formation, the natural earth formation pressure is not impeded to restrict or prevent the flow of the liquid and gas into the well during a significant portion of the recovery cycle. Instead, the earth formation pressure, diminished as it may be at the later stages of a well's life, remains available to move the liquid and gas into the well for a significant portion of the recovery cycle.

Another improvement available from U.S. Pat. No. 5,911,278 is that an evacuation pressure is applied to the casing annulus and the hydrocarbon-bearing zone of the earth formation during certain phases of the recovery cycle. The diminished or evacuation pressure has the effect of augmenting the natural earth formation pressure, thereby enhancing the flow of liquids and gas into the well. As a result, the production efficiency of the well is enhanced, which is particularly important in the later stages of a well's life where the natural earth formation pressure has already diminished.

SUMMARY OF THE INVENTION

This invention is directed to an improved recovery cycle for a pressurized gas lift apparatus, such as the type described in U.S. Pat. No. 5,911,278. In the present invention, an additional phase is included within the recovery cycle. The additional phase involves the evacuation of all three chambers created by the well casing, a production tubing within the well casing, and a lift tubing within the production tubing. The evacuation of all three chambers during the three chamber evacuation phase of the recovery cycle has the benefit of enhancing natural gas production by augmenting earth formation pressure to recover the gas at a higher rate within a given period of time. In addition, the three chamber evacuation phase facilitates a condition where the produced natural gas may be delivered to a sales line or pipeline that has a relatively high pressure.

The present invention involves a method of recovering natural gas from a well by executing a multiple-phase gas recovery cycle. The gas recovery cycle includes a liquid capture phase in which pressurized gas moves liquid from the well into a production chamber defined within a production tubing inserted into the well, a liquid removal phase in which pressurized gas lifts liquid out of the well through a lift chamber defined by a lift tubing inserted at least partially within the production chamber, and a production phase during which natural gas is removed from the well in a casing chamber defined by production tubing and a casing within the well. During the production phase the gas is pressurized and flowed through the production chamber and the lift chamber for delivery to a sales conduit. In addition, the gas recovery method and cycle includes a new and improved three chamber evacuation phase which is executed by applying relatively low pressure within the casing chamber, production chamber and lift chamber after completion of the liquid removal and production phases and before execution of the liquid capture phase. The relatively low pressure applied within all three chambers augments the natural earth formation pressure to produce natural gas and liquid into the well at a greater rate than would otherwise result. The four phases of the gas recovery cycle are arranged to take advantage of the greater production rate by more rapidly removing the liquid from the well bottom to maintain natural gas production and increase the volumetric rate of its production. Moreover, the three chamber evacuation phase permits the produced natural gas to be pressurized, if necessary, to be delivered directly into a relatively high-pressure sales conduit or pipeline.

Other beneficial aspects of the three chamber evacuation phase in the gas recovery cycle include flowing at least some of the natural gas from the casing chamber directly to the sales conduit, and moving accumulated liquid from the casing chamber into the production chamber during the three chamber evacuation phase and prior to executing the liquid capture phase. The three chamber evacuation phase may be selectively terminated upon sensing a predetermined amount of natural gas flow from the casing chamber and a predetermined pressure of natural gas in the casing chamber, under conditions which correlate to an amount of accumulated liquid which may be lifted from the well bottom without exceeding the capacity of a compressor used to lift the accumulated liquid.

Another aspect of the present invention involves a gas recovery method that includes a well evacuation phase in a gas recovery cycle during which relatively low gas pressure is applied throughout the well and on an earth formation from which the gas and liquid produced at a bottom of the well, thereby augmenting the natural earth formation pressure to increase the volumetric flow rate of the natural gas and liquid into the well. The gas recovery cycle beneficially maintains the increased volumetric flow by increasing the volumetric removal rate of the liquid from within the well. Moreover, the well evacuation phase facilitates pressurizing of the gas produced from the well for delivery to a high-pressure sales conduit, if necessary.

Another aspect of the present invention involves a system controller in a gas recovery apparatus which has been programmed to control a compressor and the gas flow path established through controllable valves for the purpose of executing a gas recovery cycle involving an improved three chamber phase or a well evacuation phase of the nature described.

A more complete appreciation of the present invention and its scope may be obtained from the accompanying drawings, which are briefly summarized below, from the following detail descriptions of presently preferred embodiments of the invention, and from the appended claims.

DETAILED DESCRIPTION

Figures 1, 2:
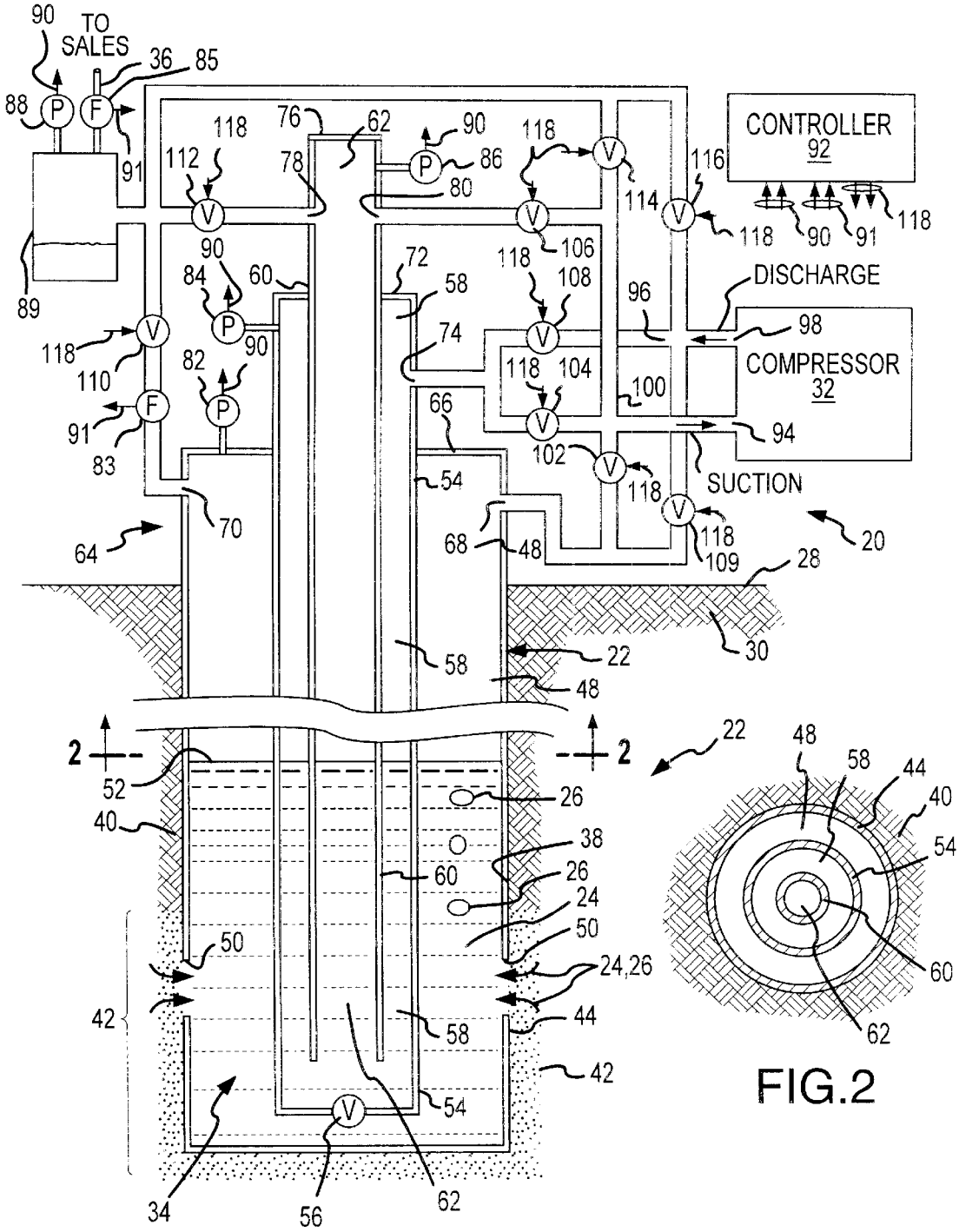
FIG. 1 is a schematic and block diagram of a gas recovery apparatus of the present invention installed in a schematically-illustrated natural gas producing well, all of which also illustrates the methodology for the present invention
FIG. 2 is cross-section view of the well shown in FIG. 1, taken substantially in the plane of line 2—2 of FIG. 1.

A gas recovery apparatus 20 which operates in accordance with the present invention is shown in FIG. 1, used in a well 22 which produces liquid 24 and natural gas 26. The liquid 24, which is primarily water in a gas well but which may contain some oil, is lifted out of the well 22 to the surface 28 of the earth 30 by operation of the gas recovery apparatus 20. In general, the gas recovery apparatus 20 includes a compressor 32 which supplies pressurized gas, preferably pressurized natural gas 26, to a bottom 34 of the well 22. The pressurized gas forces the liquid 24 accumulated in the well bottom 34 to the surface 28. Natural gas 26 is also removed from the well at the earth surface 28, and the produced natural gas 26 is delivered to a sales conduit 36 for later commercial sales and use.

The well 22 is formed by a well bore 38 which has been drilled or otherwise formed downward into a subterranean formation 40 of the earth 30. The well bore 24 extends downward to a depth or level where it penetrates a subterranean zone 42 which contains the natural gas 26. A conventional well casing 44 is inserted into the well bore 38 to preserve the integrity of the well 22. The casing 44 is typically formed by a number of connected pipes or tubes (not individually shown) which extend from a wellhead 46 at the surface 28 down to the well bottom 34. In relatively shallow and moderate-depth wells 22, the connected pipes which form the casing 38 extend continuously from the wellhead 46 to the well bottom 34. In relatively deeper wells 22, a conventional liner (not shown) is formed by connected pipes or tubes of lesser diameter at the lower depths of the well bore 38. The liner functions to maintain the integrity of the well 22 at its lower depths. A conventional packer (not shown) is used to transition from the relatively larger diameter casing 44 to the relatively smaller diameter liner at the mid-depth location where the liner continues on from the lower end of the casing 44. Because the liner can be considered as a smaller diameter version of the casing 44, the term "casing" is used herein to refer both to the circumstance where only a single diameter pipe extends from the earth surface 28 to the well bottom 34, and to the circumstance where larger diameter pipe extends from the earth surface 28 part way down the well bore 38 to a point where slightly lesser diameter liner continues from a packer on to the well bottom 34. The interior area circumscribed by the casing 44 is referred to as a casing chamber 48 (also shown in FIG. 2).

Perforations 50 are formed through the casing 44 at the location of the hydrocarbon-bearing zone 42. The perforations 50 admit the liquid 24 and natural gas 26 from the hydrocarbon-bearing zone 42 into the casing chamber 48. The perforations 50 are conventionally located a few tens of feet above the well bottom 34. The volume within the casing chamber 48 beneath the perforations 40 is typically referred to as a catch basin or "rat hole." The well bottom 34 includes the catch basin.

Natural pressure from the hydrocarbon-bearing zone 42 causes the liquid 24 and natural gas 26 to flow from the zone 42 through the perforations 50 and into the casing chamber 48. The liquid 24 accumulates in the casing chamber 48 until a vertical column of the liquid extends above the perforations 50 within the casing 44. Generally speaking, the gas 26 enters the column of liquid from the perforations 50, bubbles to the top of the accumulated liquid column, and enters the casing chamber 48. As shown in FIG. 1, the column of liquid reaches a level represented at 52 which is established by the natural earth formation pressure. At that height, the hydrostatic head pressure from the column of liquid 24 counterbalances the natural earth formation pressure, and the flow of liquid and gas from the zone 42 into the well bottom 34 ceases because there is no pressure differential to move the liquid and gas into the well bottom 34. Under these conditions, the well 22 is said to die or choke off, because no further liquid or gas can be produced into the well because the hydrostatic pressure of the column of accumulated liquid counterbalances the natural earth formation pressure.

Until the level of accumulated liquid rises to the point where its hydrostatic head pressure counterbalances the natural earth formation pressure, natural gas flows from the zone 42 into the casing 44 and bubbles upward from the perforations 50 through the accumulated liquid column. If the level of accumulated liquid in the well bottom 34 is not above the level of the perforations 50, the natural gas 26 will enter the casing chamber 48 from the zone 42 without bubbling through the liquid. However when the accumulated liquid column reaches a sufficient height to choke off the well, the hydrostatic pressure from that column of liquid prevents the flow of natural gas into the casing chamber 48.

To prevent the well from dying and choking off, the level 52 of the accumulated liquid column must be kept low enough that its hydrostatic head pressure is less than the natural earth formation pressure. This is accomplished by removing the liquid from the well bottom 34 to reduce the height of the accumulated liquid column. The liquid is removed by pumping or lifting it out of the well 22. Reducing the height level 52 of the liquid 24 reduces the amount of hydrostatic pressure created by the accumulated liquid, and thereby permits the natural earth formation pressure to remain effective to flow more liquid and gas into the well.

As the well continues to produce over its lifetime, the amount of natural earth formation pressure diminishes. It becomes more important to keep the height level 52 of the accumulated liquid 24 low enough so that the diminished formation pressure remains effective in moving the gas and liquid into the well. Moreover, as liquid 24 is removed from the well, a natural pressure transition throughout the zone 42 occurs where the natural earth formation pressure at the perforations 50 is somewhat less than the natural earth formation pressure at locations spaced radially outwardly from the perforations 50. This zone of slightly diminished natural earth formation pressure, shaped somewhat like a cone, results because the zone 42 has certain natural permeability and flow characteristics which inhibit instantaneous pressure equilibrium throughout the zone 42. Thus, as liquid is removed from the well bottom 34, there will be an effective reduction in natural earth formation pressure simply as a result of the removal of the liquids. The level 52 of liquid 24 must be maintained at a low enough level that its hydrostatic head pressure remains below this flowing bottom hole pressure from the earth formation.

To remove the liquid 24, the gas recovery apparatus 20 includes a string of production tubing 54 which is inserted into the casing chamber 48 and which extends from the surface 28 to the well bottom 34. The production tubing 54 is of a lesser diameter than the diameter of the casing 44, thereby causing the casing chamber 48 to assume an annular shape (FIG. 2) between the exterior of the production tubing 54 and the interior of the casing 44. The lower end of the production tubing 54 extends into the catch basin or well bottom 34 at or below the perforations 50. The lower end of the production tubing 54 is closed by a one-way valve 56 at the bottom end of the production tubing 54. The production tubing 54 circumscribes a production chamber 58 (FIG. 2) which is located within the interior of the production tubing 54.

The one-way valve 56 opens to allow liquid to pass from the casing chamber 48 into the production chamber 58, when pressure in the casing chamber 48 at the one-way valve 56 is greater than or equal to the pressure inside of the production tubing 54 at the one-way valve 56. However, when the pressure inside of the production tubing 54 at the one-way valve 56 is greater than the pressure in the casing chamber 48, the one-way valve 56 closes to prevent liquids within the production chamber 58 from flowing backwards through the valve 56 into the casing chamber 48. The one-way valve 56 is preferably one or more conventional standing valves. Two or more standing valves in tandem offer the advantage of redundancy which permits continuing operations even if one of the standing valves should fail.

A string of lift tubing 60 is inserted within the production tubing 54. The lift tubing 60 extends from the earth surface 28 and terminates at a lower end near the one-way valve 56, for example approximately a few feet above the bottom end of the production tubing 54. An open bottom end of the lift tubing 60 establishes a fluid communication path from the production chamber 58 to the interior of the lift tubing 60. The interior of the lift tubing 60 constitutes a lift chamber 62 through which the liquids from the well bottom 34 flow upward to the earth surface 28. The lift tubing 60 causes the production chamber 58 to assume an annular configuration, while the lift chamber 62 is generally circular in cross-sectional size, as shown in FIG. 2.

Although shown in FIG. 2 as positioned concentrically, the production tubing 54 and the lift tubing 60 may not necessarily be centered about the axis of the casing 44. Moreover, the lift tubing 60 need not be positioned within the production tubing 54 along the entire depth of the well bore 38, so long as there is fluid communication between the lift chamber 62 and the production chamber 58, and so long has there is communication between the chambers 58 and 62 and the casing chamber 48 through the one-way valve 56 in the manner described herein.

The natural formation pressure from the hydrocarbon-bearing zone 42 causes liquid 24 in the casing chamber 48 to pass through the one-way valve 56 and enter the production chamber 58 and the lift chamber 62, when the chambers 58 and 62 experience a relatively lower pressure than is present in the well bottom 34 as a result of the natural earth formation pressure. The levels of the liquid 24 within the production chamber 58 and the lift chamber 62 increase until the levels of the liquid in the chambers 58 and 62 are approximately equal to the level of the liquid in the casing chamber 48, under initial starting conditions where the pressure in the casing chamber 48 is approximately the same as the pressure within the chambers 58 and 62. These initial starting conditions prevail before the compressor 32 begins to create pressure differentials between the chambers 48, 58 and 62 during the different phases of the recovery cycle of the present invention.

The casing 44, the production tubing 54 and the lift tubing 60 extend from the well bottom 34 to a wellhead 64 located at the earth surface 28. A cap 66 closes the top end of the casing 44 against to the production tubing 54, thus closing the upper end of the casing chamber 48 at the wellhead 64. Ports 68 and 70 extend through the casing 44 to communicate with the closed upper end of the casing chamber 48 at the wellhead 64. A cap 72 closes the top end of the production tubing 54 against the lift tubing 60, thereby closing the upper end of the production chamber 58 at the wellhead 64. A port 74 extends through the production tubing 54 to communicate with the upper end of the production chamber 58 at the wellhead. A cap 76 closes the upper end of the lift tubing 60 at the wellhead 64. Ports 78 and 80 are formed through the lift tubing 60 to communicate with the upper end of the lift chamber 62 at the wellhead 64. The ports 68, 70, 74, 78 and 80 connect to conduits and valves which interconnect the casing chamber 48, the production chamber 58 and the lift chamber 62 to the compressor 32 and to the sales conduit 36.

Pressure sensors 82, 84 and 86 connect to the casing chamber 48, the production chamber 58 and the lift chamber 62 for the purpose of sensing the pressures within those chambers, respectively. A pressure sensor 88 is also connected to a conventional liquid-gas separator 89 which is connected to receive a flow of liquid and gas from the well bottom 34. The liquid-gas separator 89 separates the liquid from the gas, and delivers the gas to the sales conduit 36. The pressure sensor 88 senses the pressure within the liquid-gas separator 89, and that pressure is the same as the pressure within the sales conduit 36. The pressure sensors 82, 84, 86 and 88 supply individual signals indicative of the individual pressures that they sense to a system controller 92. The pressure signals supplied by the pressure sensors 82, 84, 86 and 88 are collectively referenced 90.

A flow sensor 83 is connected in series with the port 70 from the casing chamber 48. The flow sensor 83 measures the amount of natural gas, if any, which is volunteered by the well. The volunteered natural gas flows from the casing chamber 48, into the separator 89 and from their into the sales conduit 36. A flow sensor 85 is connected between the liquid-gas separator 89 and the sales conduit 36. The flow sensor 85 measures the amount of natural gas flowing from the well 22 and gas recovery apparatus 20 into the sales conduit 36. The flow sensors 83 and 85 supply individual signals representative of the flow of gas through them. Each flow sensor 83 and 85 supplies an individual flow signal representative of the volumetric gas flow through it, to the system controller 92. The individual flow signals from the flow sensors 83 and 85 are collectively referenced 91.

The compressor 32 includes a suction port 94, which is connected to a suction manifold 100, and a discharge port 98, which is connected to a discharge manifold 96. The compressor 32 operates in the conventional manner by creating relatively lower pressure gas at the suction port 94, compressing the gas received at the suction port 94, and delivering the compressed or relatively higher pressure gas through the discharge port 98. The compressor 32 thus creates a pressure differential between the relatively lower pressure gas at the suction port 94 and the relatively higher pressure compressed gas at the discharge port 98. The pressure differential created by the compressor 32 is used to create the phases of the gas recovery cycle of the gas recovery apparatus 20. The compressor 32 is sized to have a sufficient volumetric capacity, and to create sufficient pressure differentials, to perform the gas recovery cycle described below.

The suction manifold 100 and the discharge manifold 96 are preferably connected together by conventional start-up by-pass and swing check valves (not shown). The start-up bypass valve allows the compressor to be started without a load on it. The swing check valve is a one-way valve that opens if the pressure in the suction manifold 100 exceeds the pressure in the discharge manifold 96. Higher pressure in the suction manifold compared to the pressure in the discharge manifold may occur momentarily during transitions between the various phases of the gas recovery cycle.

Motor or control valves 102,104 and 106 connect the suction manifold 100 through the ports 68, 74 and 80 to the casing chamber 48, the production chamber 58 and the lift chamber 62, respectively. Motor or control valves 108 and 109 connect the discharge manifold 96 through the ports 74 and 68 to the production chamber 58 and the casing chamber 48, respectively. Motor or control valves 110 and 112 connect the casing chamber 48 and the lift chamber 62 through the ports 70 and 78 to the sales conduit 36, respectively. Motor or control valves 114 and 116 connect the suction manifold 100 and the discharge manifold 96 to the sales conduit 36, respectively.

The control valves 102, 104, 106, 108, 109, 110, 112, 114 and 116 are opened and closed in response to valve control signals applied to each valve by the system controller 92. The valve control signals are collectively referenced 118 in FIG. 1. The controller 92 preferably includes a microprocessor-based computer or microcontroller which executes a program to deliver the valve control signals 118 to the control valves 102, 104, 106, 108, 109, 110, 112, 114 and 116 under the circumstances described below to cause the gas recovery apparatus 20 to execute the gas recovery cycle. The controller 92 establishes the opened and closed states of the control valves in accordance with its own programmed functionality, by timing phases involved with the phases of the gas recovery cycle, and/or by responding to the pressure signals 90 and the flow signals 91 during the phases of the gas recovery cycle, among other things. Although shown separately as control valves in FIGS. 1 and 4–7 for purposes of simplification of explanation, the flow conditions and phases described below can be achieved by other types of valve devices, such as one-way check valves, pressure regulators and the like used in combination with a lesser number of control valves.

The phases of the gas recovery cycle are created when the system controller 92 controls the opened and closed states of the control valves to cause the compressor 32 to create pressure conditions within the chambers 48, 58 and 62. These pressure conditions, described in greater detail below, lift liquid through the lift tubing 60 to remove accumulated liquid 24 in the well bottom 34 and thereby control the level 52 of the liquid 24, to keep the well producing natural gas 26. The gas recovery apparatus 20 offers the advantage of removing the liquid to control the liquid level even in relatively deep wells 22 and under conditions of diminished natural earth formation pressure.

The structure and equipment of the gas recovery apparatus 20 and the characteristics of the well 22 are essentially the same as those described in U.S. Pat. No. 5,911,278. However, the present gas recovery apparatus 20 is operated differently, resulting in a new and improved gas recovery cycle 120, shown in FIG. 3. The gas recovery cycle 120 includes a liquid capture phase 122 which is established by the condition of the gas recovery apparatus 20 shown in FIG. 4, a liquid removal phase 124 which is established by the condition of the gas recovery apparatus 20 shown in FIG. 5, a production phase 126 which is established by the condition of the gas recovery apparatus 20 shown in FIG. 6, and a three chamber evacuation phase 128 which is established by the condition of the gas recovery apparatus 20 shown in FIG. 7. The gas recovery cycle 120, established by the four phases 122, 124, 126 and 128 (FIG. 3), is continuously repeated to remove accumulated liquid 24 from the well bottom 34 to promote the greater production of natural gas 26. The liquid capture, liquid removal and production phases are somewhat similar or related to similar phases involved in the recovery cycle described in U.S. Pat. No. 5,911,278. However, the time duration of one entire gas recovery cycle 120, from the beginning of the liquid capture phase 122 to the beginning of the next liquid capture phase 122, may be made shorter in time as a result of including the additional three chamber evacuation phase in the gas recovery cycle 120, resulting in a greater volumetric rate of natural gas production in a given time, and also resulting in the ability to deliver the natural gas to a sales conduit 36 which has a relatively high pressure, among other substantial advantages and improvements. The improvements and advantages obtained by including the three chamber evacuation phase 128 in the gas recovery cycle 120 is particularly important at the end of a well's lifetime, because these improvements allow the well to be worked economically under circumstances which might make working the well otherwise impractical.

Figure 3:
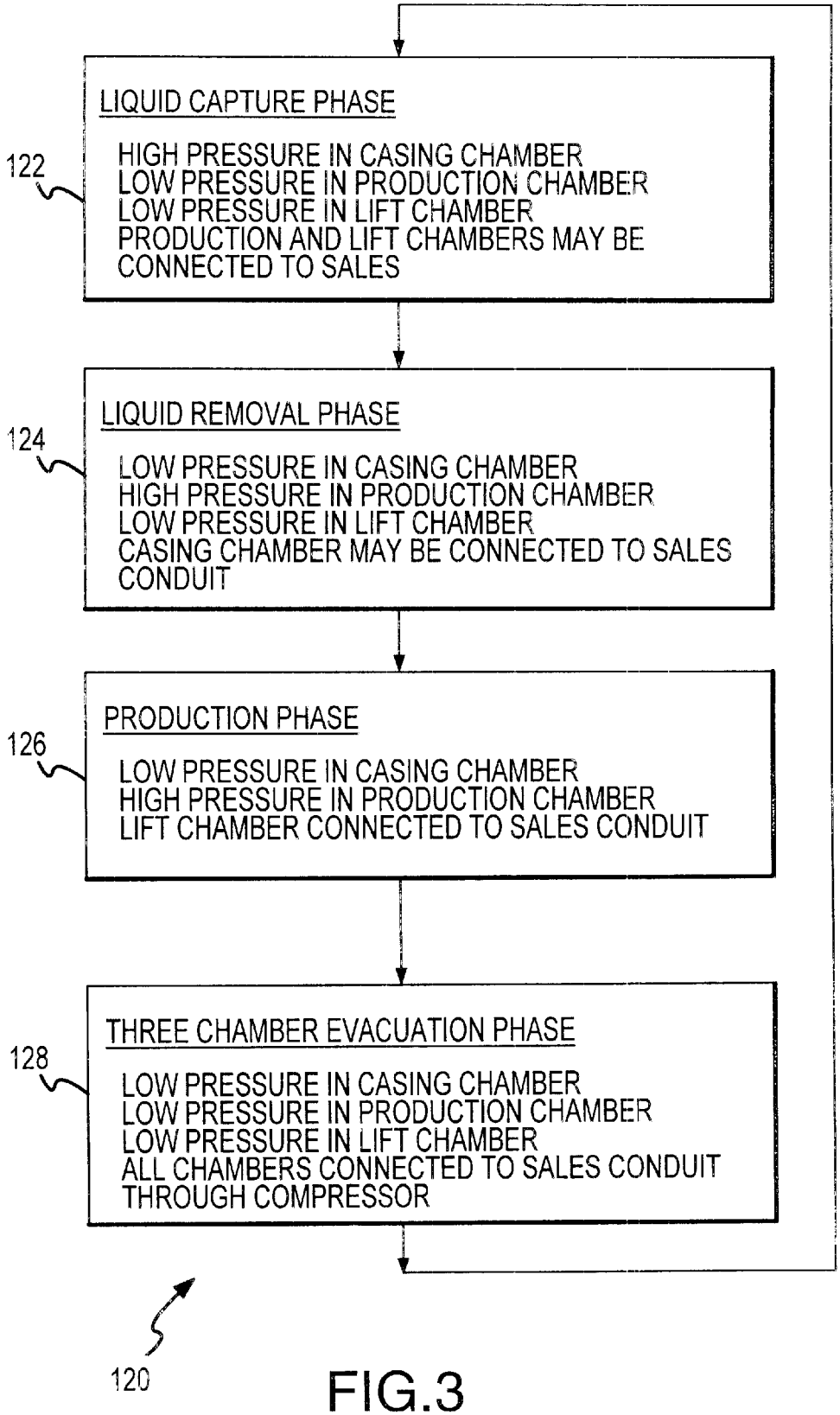
FIG. 3 is a flowchart of a gas recovery cycle of a gas recovery apparatus and method of the present invention, comprising a liquid capture phase, a liquid removal phase, a production phase and a three chamber evacuation phase of a gas recovery cycle of the gas recovery apparatus and method shown in FIG. 1.
Figure 4:
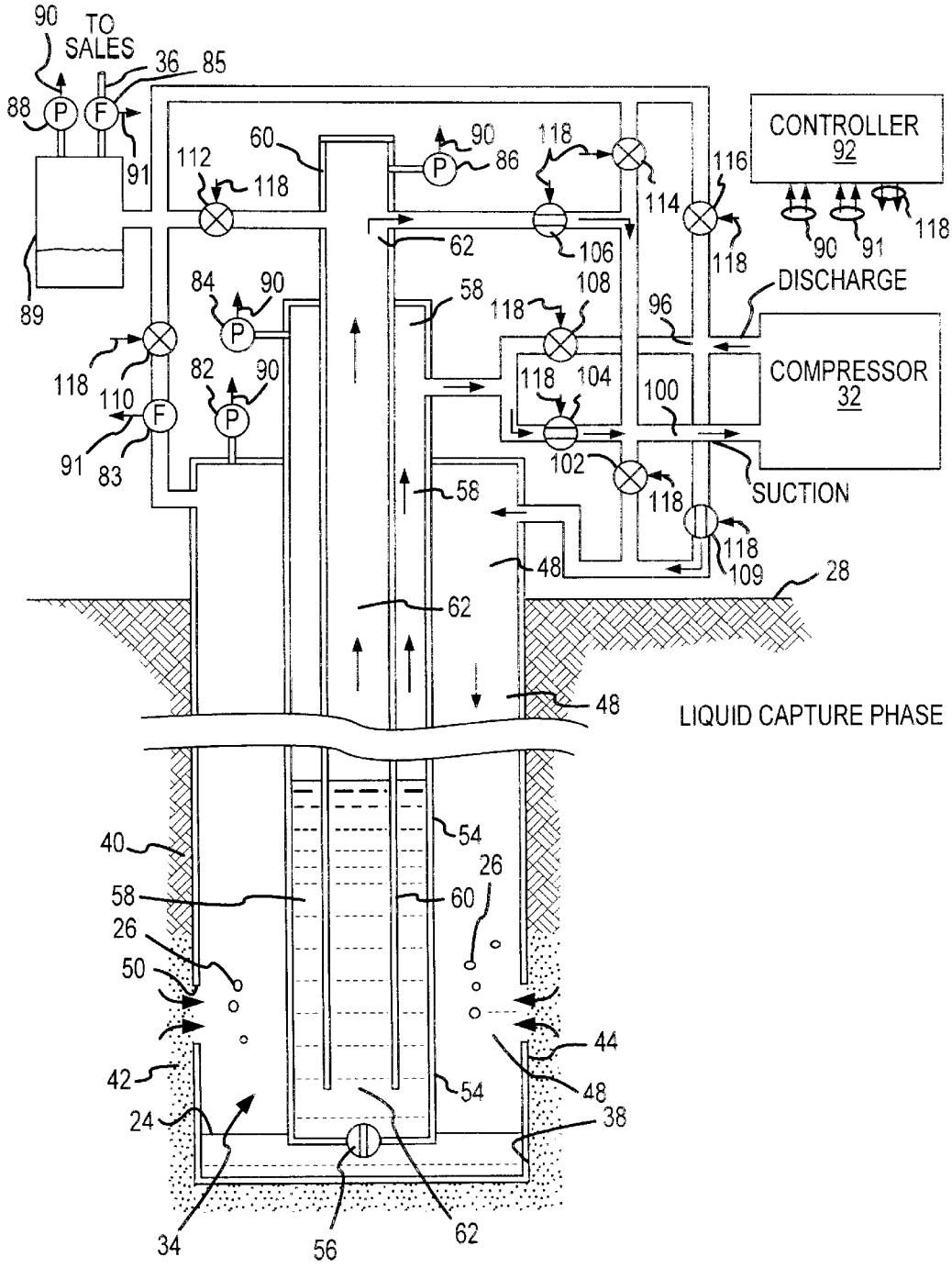
FIG. 4 is a simplified schematic and block diagram similar to FIG. 1 illustrating performance of the liquid capture phase of the gas recovery cycle shown in FIG. 3.

During the liquid capture phase 122 shown in FIGS. 3 and 4, relatively low pressure or suction pressure is applied to the production chamber 58 and the lift chamber 62, and relatively high pressure is applied to the casing chamber 48. The control valves 104 and 109 are opened by the controller 92, causing the lift chamber 62 and the production chamber 58 to be connected to the suction manifold 100 of the compressor 32 and causing the casing chamber 48 to be connected to the discharge manifold 96. The control valves 102, 108, 112, 114 and 116 are closed by the controller 92. In some wells and in some working circumstances, it is not necessary to apply the relatively high pressure to the casing chamber 48. Instead, the well may volunteer or naturally produce gas that creates a sufficient natural pressure within the casing chamber 48 so that adequate pressure differential is created at the one-way valve 56 to move the accumulated liquid from the casing chamber 48 through the valve 56 and into the production chamber 58. The natural gas volunteered by the well simply creates a sufficient pressure within the casing chamber 48 to accomplish the liquid capture phase (FIG. 4). When this is the case, the control valve 110 is opened slightly so as to maintain a preset pressure in the casing chamber 48. The compressed natural gas delivered through the open control valve 109 flows into the casing chamber 48 and then through the opened valve 110 and into the sales conduit 36 through the separator 89. Thus, under these circumstances, the gas removed from the production chamber 58 and the lift chamber 62 is conducted through the compressor 32, and the opened valves 109 and 110 into the sales conduit 36. Another configuration would be to leave valves 109 and 110 closed and open valve 116 to deliver gas to the sales conduit 36. This will allow pressure in the casing chamber 48 to build at a rate determined only by the gas contributed from the formation.

Assuming that the well does not volunteer sufficient natural gas, with the control valves in the state shown in FIG. 4, the compressor creates a relatively low or suction pressure within the production chamber 58 and the lift chamber 62, and creates a relatively high pressure in the casing chamber 48. The relatively low pressure within the production and lift chambers 58 and 62 is below the hydrostatic head pressure of the accumulated column of liquid 24 at the well bottom 34. The relatively high pressure in the casing chamber 48 may slightly increase the pressure at the well bottom 34 beyond that pressure created by the head of the accumulated liquid.

The reduced pressure within the production and lift chambers 58 and 62 creates a pressure differential relative to the higher pressure in the casing chamber 48, and that pressure differential opens the one-way valve 56 to admit the accumulated liquid into the production and lift chambers 58 and 62. The one-way valve 56 remains open until the pressure at the well bottom 34 in the production chamber 58 exceeds the pressure in the casing chamber 48, which occurs during the liquid removal and production phases of the gas recovery cycle. The pressure sensors 84 and 86 register a slightly increase in pressure when the liquid enters the bottom end of the production chamber 58 and the lift chamber 62.

Figure 5:
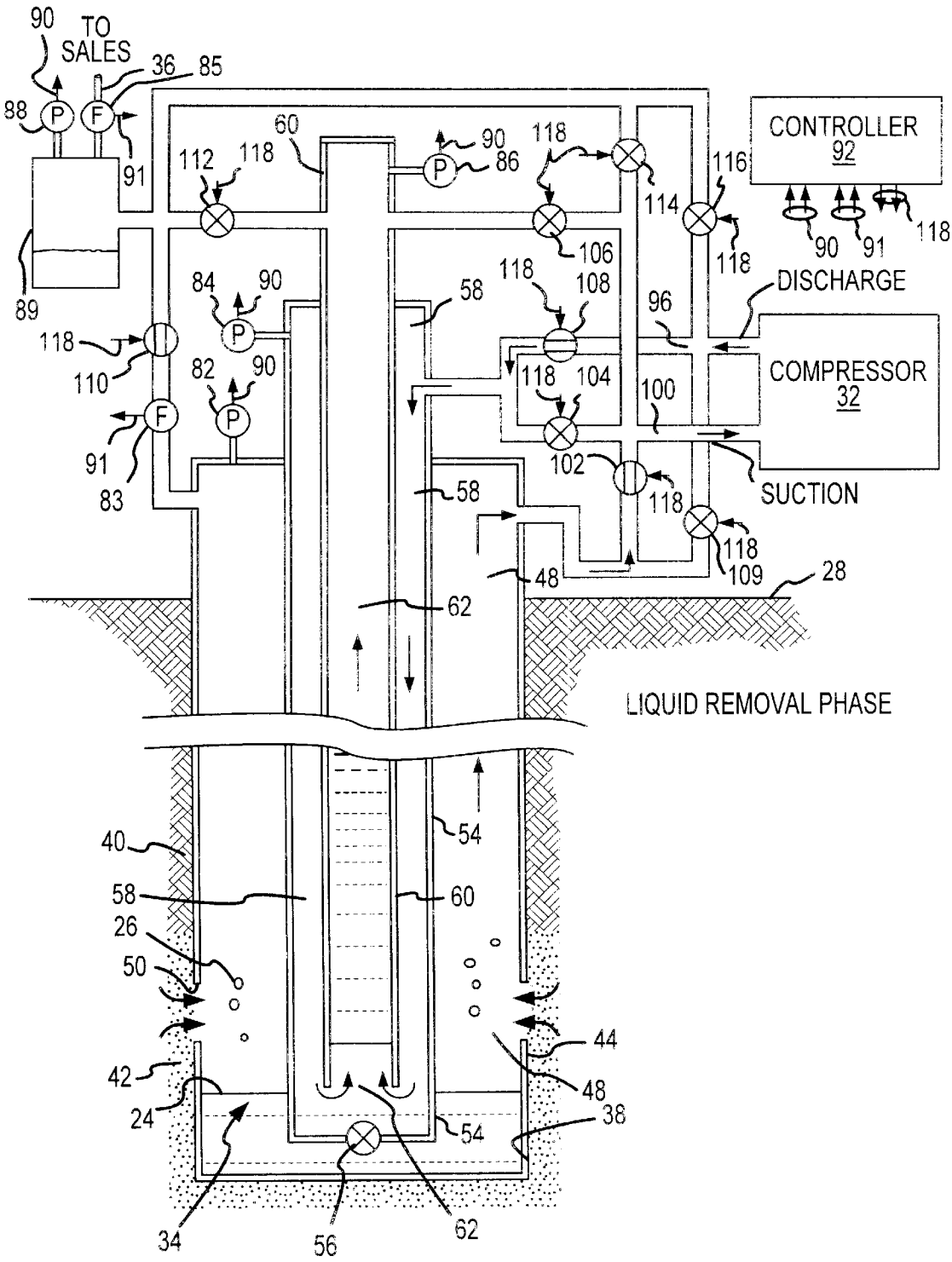
FIG. 5 is a simplified schematic and block diagram similar to FIG. 1 illustrating performance of the liquid removal phase of the gas recovery cycle shown in FIG. 3.

Once the pressure sensors 84 and 96 have supplied signals indicating that the pressure within the production chamber 58 has increased to a predetermined level signifying that the liquid has entered the production chamber 58, or once a predetermined time period for performing the liquid capture phase (FIGS. 3 and 4) has elapsed, the controller 92 transitions the state of the control valves from the liquid capture phase 122 (FIG. 4) to a state for performing the liquid removal phase 124 of the gas recovery cycle 120 shown in FIGS. 3 and 5.

In the liquid removal phase 124 shown in FIGS. 3 and 5, the control valves 102 and 108 are opened and the valves 104, 106, 109, 110, 112, 114 and 116 are closed, by the controller 92 delivering the control signals 118 to these valves. With the valves in these states, the casing chamber 48 is connected to the relatively low or suction pressure from the suction manifold 100, and the production chamber 58 is connected to the relatively high pressure from the discharge manifold 96. The relatively low pressure within the lift chamber 62 which was established in the previous liquid capture phase 122 (FIG. 4) is trapped within the lift chamber 62 by the closure of valve 106. The relatively low pressure created in the casing chamber 48 by the suction of the compressor 32 immediately starts to assist the natural earth formation pressure in moving the liquids and natural gas from the zone 42 into the well. The gas removed from the casing chamber 48 is compressed by the compressor 32 and delivered into the production chamber 58. The gas removed from the casing chamber 48 is thus used to lift the liquid. Any excess gas volunteered by the well beyond that required for compression and injection into the production chamber 58 may be delivered to the sales conduit 36 by opening the control valves 110 and/or 116.

The relatively high pressure from the discharge of the compressor 32 creates a relatively higher pressure in the production chamber 58, which closes the one-way valve 56, thereby confining the high pressure and the accumulated liquid within the production chamber 58. The relatively low pressure which existed previously in the lift chamber 62 during the liquid capture phase (FIG. 4) has been trapped within the closed lift chamber 62 by closing the valve 106. This trapped relatively lower pressure in the lift chamber 62 is separated from the relatively higher pressure in the production chamber 58 by the liquid at the bottom of the production tubing 54 above the one-way valve 56. The relatively higher pressure in the production chamber 58 and the trapped relatively lower pressure in the lift chamber 62 move the liquid from the bottom of the production chamber 58 into the lift chamber 62, thus filling the lift chamber 62 with the liquid captured during the preceding liquid capture phase 122 (FIG. 4).

The displacement of the liquid up and into the lift chamber 62 causes gas to flow around the lower terminal end of the lift tubing 60 and to begin bubbling up through the fluid column of liquid located in the bottom me end of the lift chamber 62. The gas flow through the liquid at the bottom end of the lift chamber 62 causes the pressure in the lift chamber 62 to increase (the trapped relatively lower pressure or vacuum decreases), and this increase in pressure is sensed by the pressure sensor 86. The increase in pressure in the lift chamber 62 indicates that the liquid from the bottom of the production chamber has entered the lift chamber 62. The controller 92 recognizes a predetermined increase of pressure within the lift chamber 62 as signifying that the liquid from the bottom of the production chamber has been loaded into the lift chamber. At this point, the controller 92 opens the valve 112, and the relatively high pressure within the production chamber 58 pushes the column of liquid up the lift chamber 62.

The liquid lifted up the lift chamber 62 and the pressurized natural gas which pushes the liquid up the lift chamber 62 are delivered through the opened control valve 112 into the gas-liquid separator 89. Within the separator 89, the liquid falls to the bottom while the gas flows through the flow sensor 85 to the sales conduit 36. The separator 89 thereby assures that the liquid from the well will not be delivered to the sales conduit 36, and permits the natural gas used to push the liquid up the lift chamber 62 to be delivered to the sales conduit 36. The liquid within the separator 89 is periodically removed.

The duration of the liquid removal phase 124 continues until the liquid in the lift tubing 62 has been delivered into the separator 89. This condition is sensed when the pressure sensor 86 supplies a signal 90 indicating that liquid has cleared from the lift tubing 60 and the flow sensor 85 signals a significant increase in the passage of gas into the sales conduit 36. Alternatively, the liquid removal phase 124 may be continued for a predetermined amount of time. At the conclusion of the liquid removal phase 124, the production phase 126 of the gas recovery cycle 120 commences, as shown in FIGS. 3 and 6.

Figure 6:
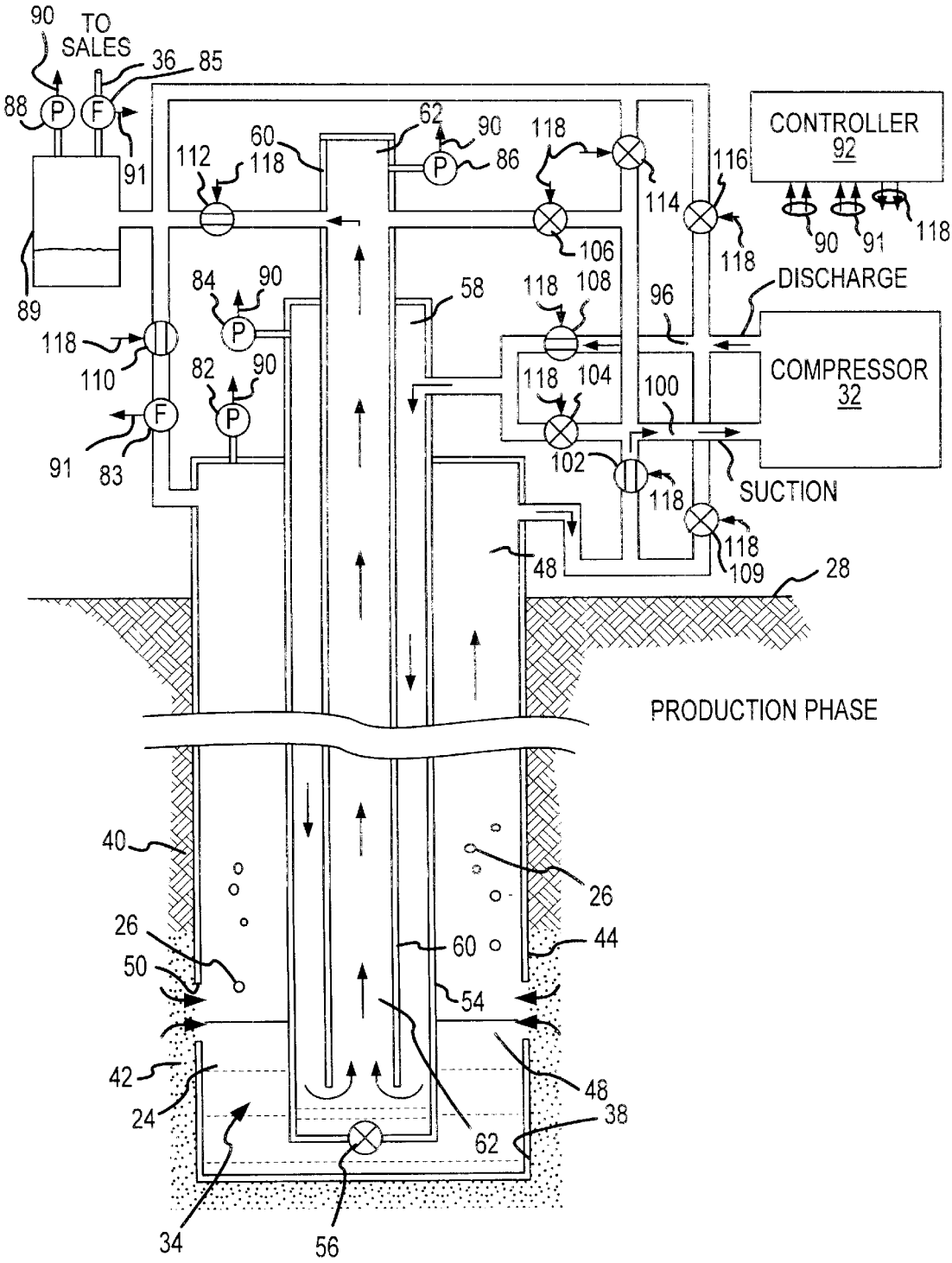
FIG. 6 is a simplified schematic and block diagram similar to FIG. 1 illustrating performance of the production phase of the gas recovery cycle shown in FIG. 3.

The production phase 126 shown in FIGS. 3 and 6 begins after the liquid has been lifted to the earths surface and has been delivered into the separator 89. The valve 112 has been opened by the controller 92 during the liquid removal phase (FIG. 5), and the control valve 106 remains closed, just as in the previous liquid removal phase. In essence, all of the valves remain in the same state in the production phase as existed at the end of the liquid removal phase 124 (FIG. 5).

The production chamber 58 and lift chamber 62 are essentially free of liquid, so that a gas flow path, unimpeded by liquid, extends from the casing chamber 48, through the compressor 32, into the production chamber 58 and up the lift chamber 62 into the sales conduit 36. This flow path allows natural gas from the casing chamber 48 to be produced and delivered to the sales conduit 36, although the flow path for doing so requires passage up the well in the casing chamber 48, down the production chamber 58 and up the lift chamber 62 to the sales conduit. Circulating gas through the production chamber 58 and up the lift chamber 62 is also effective to lift any residual liquids in the interior of the lift tubing 60, thereby more effectively clearing the liquids that were captured during the liquid capture phase. Any gas volunteered by the well during the production phase is transferred from the casing chamber 48 directly to the sales conduit 36 through the opened control valve 110. Again, whether the control valve 110 is opened during the production phase depends on the flow conditions and circumstances of the well.

The production phase 126 ends after the sensed pressure in the production chamber 58 drops to a predetermined pressure level which indicates that the flow path through the production chamber 58 and the lift chamber 62 is essentially free of liquid. Alternatively, the controller 92 may terminate the production phase 126 after a predetermined time for the production phase 126 has elapsed. At the conclusion of the production phase 126 (FIG. 3), the controller 92 is programmed to transition the state of the control valves from the production phase 126 to the new three chamber evacuation phase 128 (FIGS. 3 and 7) of the gas recovery cycle.

Figure 7:
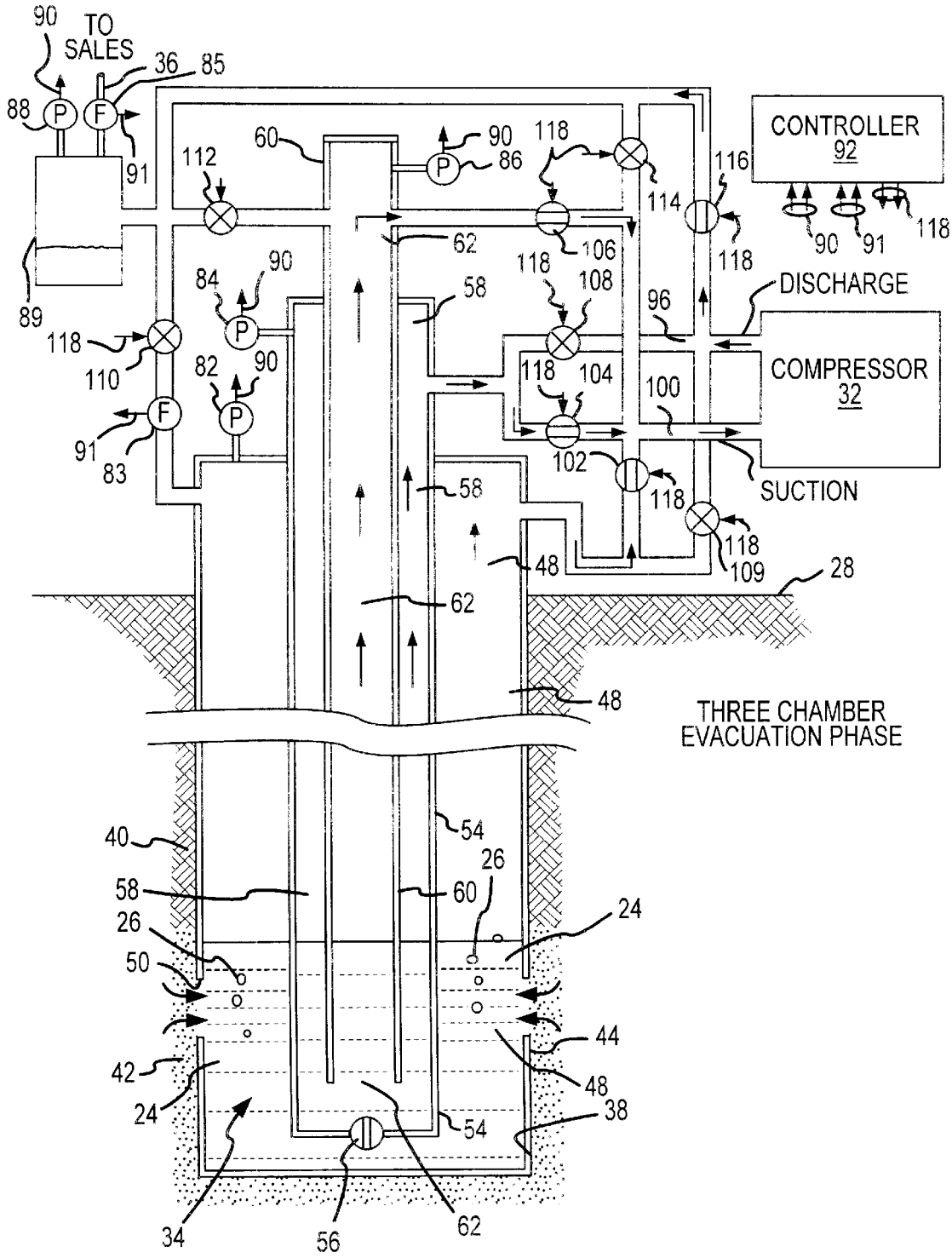
FIG. 7 is a simplified schematic and block diagram similar to FIG. 1 illustrating performance of the three chamber evacuation phase of the gas recovery cycle shown in FIG. 3.

During the three chamber evacuation phase 128 shown in FIGS. 3 and 7, relatively low or suction pressure from the compressor 32 is applied to the casing chamber 48, the production chamber 58 and the lift chamber 62. The three chamber evacuation phase 128 subjects all three chambers 48, 58 and 62 to low or suction pressure. The control valves 102,104 and 106 are opened by the controller 92, causing the lift chamber 62, the production chamber 58 and the casing chamber 48 to be connected to the suction manifold 100 of the compressor 32. The control valve 116 is also opened, connecting the discharge manifold 96 to the sales conduit 36 through the separator 89. The control valves 108, 110, 112 and 114 are closed by the controller 92. Again, depending upon the circumstances of the well, the control valve 110 may be opened to allow volunteer gas to flow directly into the separator 89 and the sales conduit 36, although normally speaking the control valve 110 will not be opened. With the control valves in this described state, the compressor creates relatively low pressure within the three chambers 48, 58 and 62, and within the entire well. The natural gas which is evacuated from the chambers 48, 58 and 62 is compressed by the compressor 32 and is delivered to the sales conduit 36. Compressing the natural gas before delivering it through the opened control valve 116 to the sales conduit assures that there is sufficient pressure to flow the natural gas directly into the sales conduit, even under circumstances were the pressure within the sales conduit is relatively high.

Natural gas is produced primarily from the casing chamber 48, as a result of the low or suction pressure of the compressor 32 lifting the gas to the earth surface as gas enters the casing chamber 48 from the hydrocarbon producing zone 42. The gas production is directly up the casing chamber 48, through the compressor 32 and into the sales conduit 36. Compared to the more circuitous flow path up the casing chamber 48, down the production chamber 58 and up the lift chamber 62 which occurs during the production phase 126 (FIGS. 3 and 6), gas production is achieved more efficiently with less flowing friction losses during the three chamber evacuation phase 128. If the natural earth formation pressure is sufficient to volunteer natural gas within the casing chamber 48 that is at a pressure sufficient to directly enter the sales conduit 36, the valve 110 may be opened to deliver that volunteered gas directly to the sales conduit in addition to delivering the compressed gas from the compressor 32 through the opened control valve 116. The beneficial effect of the natural formation pressure is not diminished by friction losses caused by forcing the gas flow through the circuitous path in the production phase 126, which again contributes to the efficiency of gas production.

The reduced pressure within the casing chamber 48 creates a greater pressure differential than would otherwise be created by the formation pressure itself. This greater pressure differential augments the natural earth formation pressure and causes the liquid and gas within the zone 42 to flow more rapidly through the perforations 50 and into the well bottom 34, thereby decreasing the amount of time required to produce the gas and liquid. Although the liquid capture phase 122 (FIG. 4) and the liquid removal phase 124 (FIG. 5) also apply relatively low pressure to the hydrocarbon zone 42 and thereby increase the flow of liquid and gas into the well bottom 34, the three chamber evacuation phase 128 continues this relatively low pressure for a greater portion of the entire gas recovery cycle 120, thereby enhancing the production of the liquid and gas.

The well evacuation phase 128 also benefits and improves the performance of the conventional liquid capture, liquid removal and production phases, by virtue of its use in combination with those conventional phases.

Moving some of the accumulated liquid into the production chamber 58 and the lift chamber 62 during the three chamber evacuation phase 128 has the net effect of eliminating some of the volume of liquid within the casing chamber 48 that has accumulated during the liquid removal and production phases 124 and 126. Reducing the accumulated volume of liquid in the casing chamber 48 reduces the height of the liquid column, thereby reducing hydrostatic pressure within the casing chamber 48, or by extending the time period during which the liquid and gas flows into the well before the liquid accumulates sufficiently to diminish substantially the flow rate into the well. This has the effect of extending the proportion of the gas recovery cycle during which the natural earth formation pressure delivers gas and liquid into the well.

The liquid which is preloaded into the production chamber 58 and lift chamber 62 during the three chamber evacuation phase 128 reduces the amount of time necessary to perform the liquid capture phase 122. By reducing the amount of time necessary to capture the liquid in phase 122, the pressurized gas is applied through the casing chamber 48 to the hydrocarbon zone 42 for a shorter proportion of time during each gas recovery cycle. As a consequence, the natural earth formation pressure remains more effective to flow gas and liquid into the well on a consistent, unimpeded basis throughout each gas recovery cycle.

The gas which is directly produced up the casing chamber 48 during the three chamber evacuation phase 128 has the effect of minimizing the amount of time during which the production phase 126 must be operated. Instead, the gas may be produced equally as well during the three chamber evacuation phase. The energy losses from the diminished efficiency of the added friction of the gas flow path up the casing chamber 48, down the production chamber 58 and up the lift chamber 62 during the production phase 126 is thereby eliminated.

Although the three chamber evacuation phase 128 as an additional phase to the gas recovery cycle 120, the beneficial effects on the other phases and the improvements from the additional three chamber evacuation phase itself actually reduces the amount of time to accomplish the overall gas recovery cycle, based on a given volume of natural gas produced.

It is important not to continue the three chamber evacuation phase 128 for such a long enough time that the liquid accumulates in the casing chamber 48 to such an extent that the liquid removal phase 124 (FIG. 5) must extend for a relatively long time period in order to lift the greater amount of accumulated fluid to the surface. Moreover, if too much liquid has accumulated, more pressure may be required to lift the liquid than the compressor 32 is capable of delivering. Thus, is important to control the length and duration of the three chamber evacuation phase 128 to obtain optimal flow conditions.

The duration of the three chamber evacuation phase 128 is established by monitoring the flow volume through the flow sensor 85 and the pressure in the casing chamber 48, the production chamber 58 and the lift chamber 62. A diminished flow through the flow sensor 85 and an decreased pressure in the chambers 48, 58 and 62, compared to the flow and pressure levels which existed at the commencement of the three chamber evacuation phase 128, indicate an increasing level of liquid at the well bottom 34. Monitoring these conditions establishes the duration of the three chamber evacuation phase, and thereby limits the amount of liquid accumulated at the well bottom during the well evacuation phase.

Another significant advantage of using the three chamber evacuation phase (FIG. 7) in the gas recovery cycle is that the pressure of the sales conduit 36 is not a limiting factor on the ability to deliver the produced natural gas into the sales conduit. Some gas pipelines or sales conduits have relatively high pressures, making it difficult to deliver the relatively lower pressure gas from the well, particularly under circumstances where the earth formation pressure in the well is already diminished at the end of a well's lifetime. By connecting all three chambers 48, 58 and 62 through the open valves 102, 104 and 106, respectively, to the suction manifold 100 of the compressor 32, the compressed gas supplied by the discharge manifold 96 through the open control valve 116 is sufficient to overcome the pressure within the sales conduit. Thus, they use of the three chamber evacuation phase 128 also assures that the pressure of the sales conduit 36 will not be a limiting factor on the ability to deliver the produced natural gas.

The gas recovery apparatus 20 of the present invention has the potential to continue producing natural gas from wells significantly beyond the commonly-considered end of a well's lifetime. Consequently, it may be possible to produce the last few percent of the oil and gas reserves contained in the hydrocarbon-bearing zone. The well will be commercially viable at a far lower formation pressure before abandonment. A typical plunger lift system needs about 300 PSI of natural formation pressure to produce from a 5,000 foot well. The gas recovery apparatus 20 of the present invention can operate the well down to 5 PSI of pressure in the casing chamber and less than 50 PSI of natural formation pressure. In addition, the gas recovery apparatus 20 can make production viable with a far wider range of gas to liquid ratios. Most importantly, the three chamber evacuation phase, and its improvement and benefits on the other conventional phases, allow the improved gas recovery cycle to recover gas reserves in a minimum amount of time, thereby making it efficient and economic to work wells that may have already reached a point where it would otherwise be uneconomical to work those wells using other techniques.

A presently preferred embodiment of the present invention and many of its improvements have been described with a degree of particularity. This description is a preferred example of implementing the invention, and is not necessarily intended to limit the scope of the invention. The scope of the invention is defined by the following claims.

The invention claimed is:

1. A method of recovering natural gas from a well in a multiple phase gas recovery cycle which includes a liquid capture phase in which pressurized gas moves liquid from the well into a production chamber defined within a production tubing inserted into the well; a liquid removal phase in which pressurized gas lifts liquid from the production chamber out of the well through a lift chamber defined by a lift tubing inserted at least partially within the production chamber; and a production phase during which natural gas is removed from the well in a casing chamber defined by a casing within the well and the production tubing and during which natural gas is pressurized and is thereafter flowed into and through the production chamber and the lift chamber for delivery to a sales conduit; and a three chamber evacuation phase executed by:

applying relatively low pressure within the casing chamber, production chamber and lift chamber after completion of the production phase and before execution of the liquid capture phase.

2. A method as defined in claim 1 further comprising:

flowing at least some of the natural gas from the casing chamber directly to the sales conduit during the three chamber evacuation phase.

3. A method as defined in claim 1 further comprising:

moving accumulated liquid from the casing chamber into the production chamber during the three chamber evacuation phase and prior to executing the liquid capture phase.

4. A method as defined in claim 1 further comprising:

selectively terminating the three chamber evacuation phase upon sensing a predetermined amount of natural gas flow from the casing chamber and a predetermined pressure of natural gas in the casing chamber.

5. A method as defined in claim 4 further comprising:

selecting the predetermined amount of natural gas flow from the chamber and the predetermined pressure of natural gas in the casing chamber at which to terminate the three chamber evacuation phase, the predetermined amount of flow and the predetermined pressure correlating to a column of accumulated liquid within the casing chamber at the well bottom.

6. A method as defined in claim 5 further comprising:

selectively terminating the three chamber evacuation phase prior to the column of accumulated liquid presenting a hydrostatic head pressure greater than the natural earth formation pressure.

7. A method as defined in claim 5 further comprising:

selectively terminating the three chamber evacuation phase prior to the column of accumulated liquid presenting a hydrostatic head pressure greater than a flowing bottom hole pressure of the subterranean earth formation which produces the gas and liquid into the well.

8. A method as defined in claim 5 further comprising:

limiting the column of accumulated liquid to an amount which results in a selected quantity of liquid to be lifted during the liquid removal phase.

9. A method as defined in claim 8 wherein the pressurized gas used during the gas recovery cycle to lift liquid through the lift chamber is supplied by a compressor having a predetermined pressurizing capacity, and the method further comprises:

establishing the selected quantity of liquid to be lifted during the liquid removal phase to create a hydrostatic head pressure within the lift chamber which does not exceed the predetermined pressurizing capacity of the compressor.

10. A method as defined in claim 8 further comprising:

establishing the selected quantity of liquid to be lifted during the liquid removal phase to extend the liquid removal phase to a duration which maximizes the amount of gas produced in each gas recovery cycle.

11. A method as defined in claim 1 further comprising:

preventing the accumulated liquid in the production chamber and the lift chamber from flowing into the casing chamber while the pressurized gas is flowed into the production chamber during the liquid removal phase.

12. A method of recovering natural gas from a well extending from an earth surface to a subterranean earth formation from which gas and liquid are produced at a bottom of the well and transported from the bottom of the well through at least one of a plurality of separate chambers extending between the well bottom and the earth surface, the method executed by using a multiple phase production cycle which includes a liquid removal phase in which pressurized gas is introduced into one chamber to lift liquid from the well bottom through one chamber to the earth surface, and which also includes:

an evacuation phase during which a relatively low gas pressure which is less than atmospheric pressure is applied to each of the plurality of chambers at the earth surface to communicate through the chambers to the well bottom and on an earth formation from which the gas and liquid are produced.

13. A method as defined in claim 12 further comprising:

including a casing chamber, a production chamber and a lift chamber in the plurality of chambers;

establishing fluid communication between the casing chamber and the earth formation from which the gas and liquid are produced; and applying the relatively low gas pressure to the casing chamber, the production chamber and the lift chamber simultaneously during the evacuation phase of the production cycle.

14. A method as defined in claim 12 further comprising:

including a casing chamber, a production chamber and a lift chamber in the plurality of chambers;

establishing fluid communication between the casing chamber and an earth formation from which the gas and liquid are produced; and applying the relatively low gas pressure to the casing chamber at the earth surface throughout the liquid removal phase and the evacuation phase of the production cycle.

15. A method as defined in claim 14 further comprising:

accumulating gas and liquid from the earth formation within the casing chamber at the well bottom during the evacuation phase; and flowing liquid from the casing chamber into the production chamber during the evacuation phase.

16. A method as defined in claim 14 further comprising:

flowing at least some of the gas directly out of the casing chamber to be sold during the evacuation phase.

17. A method as defined in claim 16 further comprising:

admitting a selected quantity of liquid from the casing chamber into the production chamber prior to executing the liquid removal phase; and preventing the liquid admitted into the production chamber from flowing back from the production chamber into the casing chamber during the liquid removal phase.

18. A method as defined in claim 12 wherein the plurality of chambers include a casing chamber, a production chamber and a lift chamber which are separate from one another, the method further comprising:

establishing fluid communication between the casing chamber and the earth formation containing the liquid and gas to be produced; and including a production phase in the gas recovery cycle during which relatively low gas pressure is applied to the casing chamber, relatively high gas pressure is applied to the production chamber and gas is delivered from the lift chamber at the earth surface.

19. A method as defined in claim 12 wherein the plurality of chambers include a casing chamber, a production chamber and a lift chamber which are separate from one another, the method further comprising:

establishing fluid communication between the casing chamber and the earth formation containing the liquid and gas to be produced; and including a liquid capture phase in the gas recovery cycle during which relatively high gas pressure is applied to the casing chamber at the earth surface, and relatively low gas pressure is applied to the production chamber and the lift chamber.

20. A method as defined in claim 19 further comprising:

obtaining gas at the earth surface from the production chamber and the lift chamber during the liquid capture phase.

21. A gas recovery apparatus for producing natural gas from a well and delivering the produced natural gas to a sales conduit, the well extending from the earth surface into a subterranean earth formation where the natural gas and liquid enter the well, the apparatus including tubing inserted into the well to create a casing chamber, a production chamber and a lift chamber which are separate from one another within the well, the gas recovery apparatus further comprising:

a compressor having a suction manifold and a discharge manifold, the compressor creating a flow of relatively low pressure gas in the suction manifold and a flow of relatively high-pressure gas in the discharge manifold;

control valves connecting each of the casing chamber, the production chamber and the lift chamber to the suction manifold and the discharge manifold to establish selective fluid communication between the suction manifold and each of the casing chamber, the production chamber and the lift chamber and to establish selective fluid communication between the discharge manifold and each of the casing chamber and the production chamber, the control valves also connecting the lift chamber and the discharge manifold to the sales conduit to establish selective fluid communication between the lift chamber and the discharge manifold and the sales conduit;

a controller programed to supply control signals to the control valves to establish an opened state of each valve to permit fluid communication therethrough and to establish a closed state of each valve to prevent fluid communication therethrough; the controller delivering a sequence of control signals to the control valves to establish the opened and closed states of the control valves which establish fluid communication conditions through the casing chamber, the production chamber, the lift chamber and into the sales conduit during a multi-phase gas recovery cycle; the gas recovery cycle including a liquid capture phase during which pressurized gas supplied by the compressor moves liquid from the well into the production chamber, a liquid removal phase in which pressurized gas supplied by the compressor lifts liquid out of the well from the production casing through the lift chamber, a production phase during which natural gas is removed from the lift chamber and delivered to the sales conduit, and a three chamber evacuation phase executed by applying relatively low pressure within the casing chamber, production chamber and lift chamber after completion of the production phase and before execution of the liquid capture phase; and wherein:

the controller establishes the states of the control valves during the liquid capture phase to establish fluid communication between the discharge manifold and the casing chamber and to establish fluid communication between the suction manifold and the production chamber and the lift chamber;

the controller establishes the states of the control valves during the liquid removal phase to establish fluid communication between the discharge manifold and the production chamber and to establish fluid communication between the suction manifold and the casing chamber and the lift chamber;

the controller establishes the states of the control valves during the production phase to establish fluid communication between the discharge manifold and the production chamber, to establish fluid communication between the suction manifold and the casing chamber, and to establish fluid communication between the lift chamber and the sales conduit; and the controller establishes the states of the control valves during the three chamber evacuation phase to establish fluid communication between the suction manifold and the casing chamber, the production chamber and the lift chamber.

22. A gas recovery apparatus as defined in claim 21 wherein:

the controller establishes the states of the control valves during the three chamber evacuation phase to establish fluid communication between the discharge manifold and the sales conduit.

23. A gas recovery apparatus as defined in claim 21 further comprising:

pressure sensors connected to sense pressure within the casing chamber, the production chamber and the lift chamber, the pressure sensors delivering pressure signals to the controller related to the sensed pressure within the casing chamber, the production chamber and the lift chamber;

flow sensors to sense the flow of natural gas from the lift chamber to the sales conduit and from the casing chamber to the sales conduit, the flow sensors delivering flow signals to the controller related to the sensed flow from the lift chamber to the sales conduit and from the casing chamber to the sales conduit; and wherein:

the controller selectively terminates each phase of the gas recovery cycle and establishes the next phase of the gas recovery cycle based on the pressure signals and the flow signals.

24. A gas recovery apparatus as defined in claim 23 wherein:

the controller times the time duration of each phase of the gas recovery cycle and also selectively terminates each phase and establishes the next phase of the gas recovery cycle based on the time duration of each phase.

25. A gas recovery apparatus as defined in claim 23 wherein:

the controller selectively terminates the three chamber evacuation phase upon a pressure signal indicating a predetermined pressure of natural gas in the casing chamber and upon a flow signal indicating a predetermined amount of natural gas flowing from the casing chamber.

26. A gas recovery apparatus as defined in claim 21 further comprising a pressure-responsive one-way valve connected between the casing chamber and the production chamber at a bottom of the well within the subterranean earth formation, the one-way valve admitting liquids from the casing chamber into the production chamber except when the pressure within the production chamber exceeds the pressure within the casing chamber.

27. A gas recovery apparatus as defined in claim 21 further comprising:

an additional control valve connecting the casing chamber to the sales conduit to establish selective fluid communication between the casing chamber and the sales conduit; and wherein:

the controller establishes the state of the additional control valve to establish fluid communication between the casing chamber and the sales conduit during one of the liquid removal phase or the production phase.

28. A gas recovery apparatus for producing natural gas from a well in a multiple phase gas recovery cycle and delivering the produced natural gas to a sales conduit, the well extending from the earth surface to a subterranean earth formation from which the natural gas and liquid are produced at a bottom of the well, the gas recovery apparatus including a plurality of separate chambers extending between the well bottom and the earth surface, the gas recovery apparatus comprising:

a compressor having a suction manifold and a discharge manifold, the compressor creating a relatively low pressure in the suction manifold and a relatively high pressure in the discharge manifold;

control valves connected to the suction manifold, the discharge manifold and the plurality of chambers at the earth surface to selectively apply the relatively low pressure and the relatively high pressure to the plurality of chambers;

a controller programmed to supply control signals to the control valves to establish an opened state of each valve to permit fluid communication therethrough and to establish a closed state of each valve to prevent fluid communication therethrough, and wherein:

the controller establishes states of the control valves to establish fluid communication between the discharge manifold and at least one chamber at the earth surface to apply the relatively high pressure to the one chamber to lift liquid from the well bottom through another chamber to the earth surface in a liquid removal phase of the gas recovery cycle; and the controller establishes states of the control valves to establish fluid communication between the suction manifold and all of the plurality of chambers at the earth surface to apply the relatively low pressure to all of the plurality of chambers and on the earth formation from which the natural gas and liquid are produced in an evacuation phase of the gas recovery cycle.

29. An apparatus defined in claim 28 wherein the plurality of chambers are a casing chamber, a production chamber and a lift chamber which are separate from one another, the casing chamber is in fluid communication with the earth formation from which the liquid and gas are produced, and wherein:

the controller establishes states of the control valves to establish fluid communication between the suction manifold and each of the casing chamber, production chamber and lift chamber approximately during the evacuation phase.

30. An apparatus defined in claim 28 wherein the plurality of chambers are a casing chamber, a production chamber and a lift chamber which are separate from one another, the casing chamber is in fluid communication with the earth formation from which the liquid and gas are produced, and wherein:

the controller establishes states of the control valves to establish fluid communication between the suction manifold and the casing chamber during all phases of the production cycle except a liquid capture phase of the gas recovery cycle; and the controller establishes states of the control valves to establish fluid communication between the discharge manifold and the casing chamber during the liquid capture phase of the gas recovery cycle.

31. An apparatus defined in claim 30 wherein gas and liquid from the earth formation are accumulated within the casing chamber at the well bottom during the evacuation phase, the apparatus further comprising:

a check valve which flows liquid from the casing chamber into the production chamber when the pressure in the production chamber is less than the pressure in the casing chamber at the well bottom and which prevents liquid within the production chamber from flowing into the casing chamber when the pressure in the production chamber is greater than the pressure in the casing chamber at the well bottom.

32. An apparatus defined in claim 28 wherein the plurality of chambers are a casing chamber, a production chamber and a lift chamber which are separate from one another, the casing chamber is in fluid communication with the earth formation from which the liquid and gas are produced, and wherein:

the controller establishes states of the control valves to establish fluid communication between the casing chamber and the sales conduit during at least one of a liquid production phase or a production phase of the gas recovery cycle.

33. An apparatus defined in claim 28 wherein the plurality of chambers are a casing chamber, a production chamber and a lift chamber which are separate from one another, the casing chamber is in fluid communication with the earth formation from which the liquid and gas are produced, and wherein:

the controller establishes states of the control valves to establish fluid communication between the suction manifold and the casing chamber and to establish fluid communication between the discharge manifold and the production chamber to deliver gas from the lift chamber during a production phase of the gas recovery cycle.

34. An apparatus according to claim 28 wherein the plurality of chambers are a casing chamber, a production chamber and a lift chamber which are separate from one another, the casing chamber is in fluid communication with the earth formation from which the liquid and gas are produced, and wherein:

the controller establishes states of the control valves to establish fluid communication between the discharge manifold and the casing chamber and to establish fluid communication between the suction manifold and the production chamber and the lift chamber to move liquid from the casing chamber at the well bottom into the production chamber and lift chamber during a liquid capture phase of the gas recovery cycle.

* * * * *